US006064848A

United States Patent [19]

Haneda

[11] Patent Number: 6,064,848

[45] Date of Patent: May 16, 2000

[54] TWO-SIDED COLOR IMAGE FORMING APPARATUS

[75] Inventor: Satoshi Haneda, Hachioji, Japan

[73] Assignee: Konica Corporation, Tokyo, Japan

[21] Appl. No.: 09/199,826

[22] Filed: Nov. 25, 1998

[30] Foreign Application Priority Data

Dec. 1, 1997 [JP] Japan ..... 9-330087

[51] Int. Cl.[7] ..... G03G 15/01; G03G 15/16

[52] U.S. Cl. ..... 399/302; 399/306; 399/308

[58] Field of Search ..... 399/302, 306, 399/308, 309

[56] References Cited

U.S. PATENT DOCUMENTS

| | | | |
|---|---|---|---|
| 4,674,857 | 6/1987 | Satomura et al. | 399/309 X |
| 5,600,408 | 2/1997 | Horiuchi et al. | 399/39 |
| 5,761,573 | 6/1998 | Haneda et al. | 399/309 X |
| 5,822,666 | 10/1998 | Haneda et al. | 399/309 |

FOREIGN PATENT DOCUMENTS

| | | |
|---|---|---|
| 49-37538 | 10/1974 | Japan . |
| 54-28740 | 9/1979 | Japan . |
| 64-44457 | 2/1989 | Japan . |
| 4-214576 | 8/1992 | Japan . |

*Primary Examiner*—Fred L. Braun

*Attorney, Agent, or Firm*—Frishauf, Holtz, Goodman, Langer & Chick, P.C.

[57] ABSTRACT

A two-sided color image forming apparatus includes: a first and second color image forming units each having an image carrier, a plurality of imagewise exposure devices and a plurality of color developing units containing respective colored toners different from each other, provided on a periphery of the image carrier; a belt-shaped intermediate transfer body passing through the first and second color image forming units for receiving a toner image formed by the second color image forming unit, wherein the first and second color image forming units are disposed downstream and upstream of a moving direction of the belt-shaped intermediate transfer body, respectively, and; a sheet pass for conveying a recording sheet onto the belt-shaped intermediate transfer body passing through between the first and second image forming units. The two-sided color image forming apparatus further includes: a second transfer device for transferring the toner image formed by the second color image forming unit onto one side of the recording sheet through the belt-shaped intermediate transfer body; and a first transfer device for transferring directly a toner image formed by the first color image forming unit onto the other side of the recording sheet, wherein each of color image formation orders for plural color toners formed respectively by the first and second color image forming units is completely reversed to each other.

9 Claims, 10 Drawing Sheets

FIG. 13 ( A )
PRIOR ART
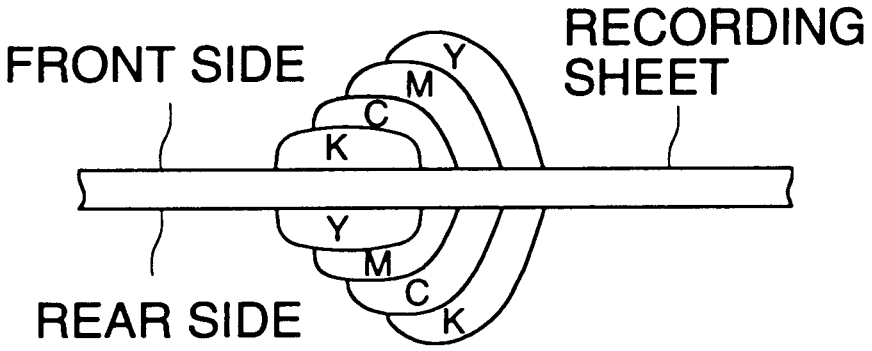
FIG. 13 ( B )
PRIOR ART
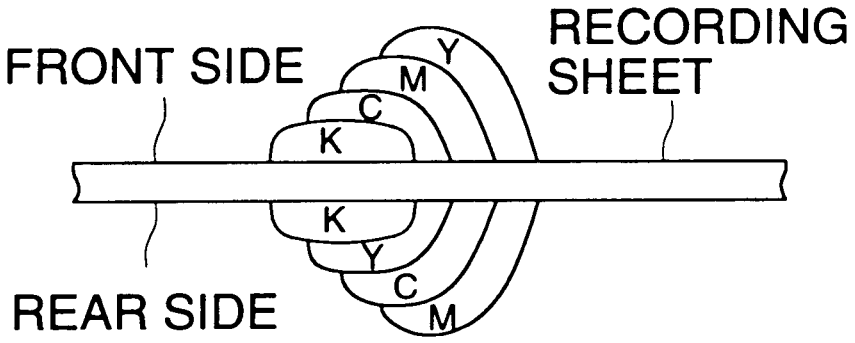

TWO-SIDED COLOR IMAGE FORMING APPARATUS

BACKGROUND OF THE INVENTION

The present invention relates to an image forming apparatus such as a copier, printer, facsimile, or similar apparatus, in which an image is formed by an electrophotographic method, and specifically relates to a two-sided color image forming apparatus by which color images are formed on both sides of a transfer material (which is also called a recording sheet).

Conventionally, in two-sided copying, the following method is adopted: one side image formed on an image carrier is transferred onto a transfer sheet (further referred to as a recording sheet), fixed thereon, and the transfer sheet is temporarily accommodated on an intermediate tray; and the recording sheet is fed from the intermediate tray in timed relationship with an image formed again on the image carrier, and the other side image is transferred onto the recording sheet and fixed thereon.

In this two-sided copying apparatus, as described above, recording sheet conveyance such as feeding to the intermediate tray, or two-time passage through the fixing unit, is carried out, therefore, reliability of the recording sheet conveyance is low, resulting in jamming. In contrast to this, a method in which, after toner images are formed on both sides of the recording sheet, fixing is conducted once, is disclosed in Japanese Patent Publication Nos. 37538/1974, 28740/1979, Japanese Patent Publication Open to Public Inspection Nos. 44457/1989, and 214576/1992.

However, in the two-sided color image formation in the above proposals, although the conveyance property of the recording sheet is increased, transfer operations are conducted twice in the rear side image formation from the image carrier to an intermediate transfer body, and from the intermediate transfer body to the recording sheet, as compared to the front side image formation in which the transfer operation is conducted only once from the image carrier to the recording sheet, therefore, the image density of the rear side image is decreased. This situation occurs for the reason that, since the transfer rate is about 90% in transfer, a toner adhering amount is lowered by about 10%. Further, the toner is scattered (a halftone dot is spread and generally $\gamma$ is increased) due to two-time toner image transferring, and the gradation property is changed. Specifically, in a color image, a color tone problem is newly generated as compared to a monochromatic image. Problems in a color toner image are shown in FIGS. 13(A) and 13(B). As shown in FIG. 13(A), the superimposition sequence of color toner is reversed in the front side and the rear side of the recording sheet, therefore, a color of the toner formed on the uppermost layer is emphasized, or color tone is changed due to toner adhering amount lowering caused by re-transfer, thereby, a problem occurs in which a color image is not finely formed. In order to correct the above problem, as shown in FIG. 13(B), even when a color image is formed in the sequence of black toner K, and Y, M, C color toner, that is, in the order of K, Y, C, M toner image to be superimposed on the rear surface, as opposed to the toner image formation sequence of Y, M, C, K of Y, M, C color toner and black toner K on the front side, a problem is generated in which color tone is different, and a color image is not finely formed.

SUMMARY OF THE INVENTION

An object of the present invention is to solve the above-described problems, and to provide a two-sided color image forming apparatus by which two-sided copying is realized at high speed, and further two-sided images can be formed with fine image density or color tone.

The above object is attained by a two-sided color image forming apparatus including: a first color image forming unit having an image carrier, a plurality of imagewise exposure means and a plurality of color developing units which contain therein respective colored toners different from each other, provided on a periphery of the image carrier; a second color image forming unit having an image carrier, a plurality of imagewise exposure means and a plurality of color developing units which contain therein respective colored toners different from each other, provided on a periphery of the image carrier; a belt-shaped intermediate transfer body passing through the first and second color image forming units for receiving thereon a toner image formed by the second color image forming unit, wherein the first color image forming unit is disposed downstream of a moving direction of the belt-shaped intermediate transfer body while the second color image forming unit is disposed upstream of the moving direction of the belt-shaped intermediate transfer body; a sheet pass for conveying a recording sheet onto the belt-shaped intermediate transfer body passing through between the first and second image forming units; a second transfer device for transferring the toner image formed by the second color image forming unit onto one side of the recording sheet through the belt-shaped intermediate transfer body; and a first transfer device for transferring directly a toner image formed by the first color image forming unit onto the other side of the recording sheet, wherein a color image formation order for plural color toners formed by the first color image forming unit is completely reversed to that for plural color toners formed by the second color image forming unit.

Further, the above object is attained by a two-sided color image forming apparatus including: a first color process unit group comprising a plurality of color process units each including an image carrier, an imagewise exposure means and a developing device containing therein colored toner different from each other for developing a latent image formed on the image carrier; a second color process unit group comprising a plurality of color process units each including an image carrier, an imagewise exposure means and a developing device containing therein colored toner different from each other for developing a latent image formed on the image carrier; a belt-shaped intermediate transfer body for receiving toner images formed by the second color process unit group, wherein the first color process unit group is disposed in a periphery and downstream of a moving direction of the belt-shaped intermediate transfer body while the second color process unit group is disposed in a periphery and upstream of the moving direction of the belt-shaped intermediate transfer body, and a sheet pass for conveying a recording sheet onto the belt-shaped intermediate transfer body passing through between the first and second process unit groups; a second transfer device provided for each of said plurality of color process units in the second color process unit group, for transferring a toner image formed by the second color process unit group onto one side of the recording sheet through the belt-shaped intermediate transfer body; and a first transfer device provided for transferring directly a toner image formed by the first color process unit group onto the other side of the recording sheet, wherein each of color image formation orders for black toner and plural color toners formed respectively by the first and second color process unit groups is entirely reversed to each other.

BRIEF DESCRIPTION OF THE DRAWINGS

FIGS. 13(A) and 13(B) are views showing problems of a color toner image.

DETAILED DESCRIPTION OF THE PREFERRED EMBODIMENT

Examples of the present invention will be described below. In the following description of examples, an image to be transferred onto a surface (one side) of a recording sheet on the side opposed to an image carrier in a transfer area when a color toner image is transferred onto the recording sheet, is referred to as the front side image, and an image to be transferred onto the other side surface of the recording sheet, is referred to as the rear side image.

EXAMPLE 1

Figure 1:
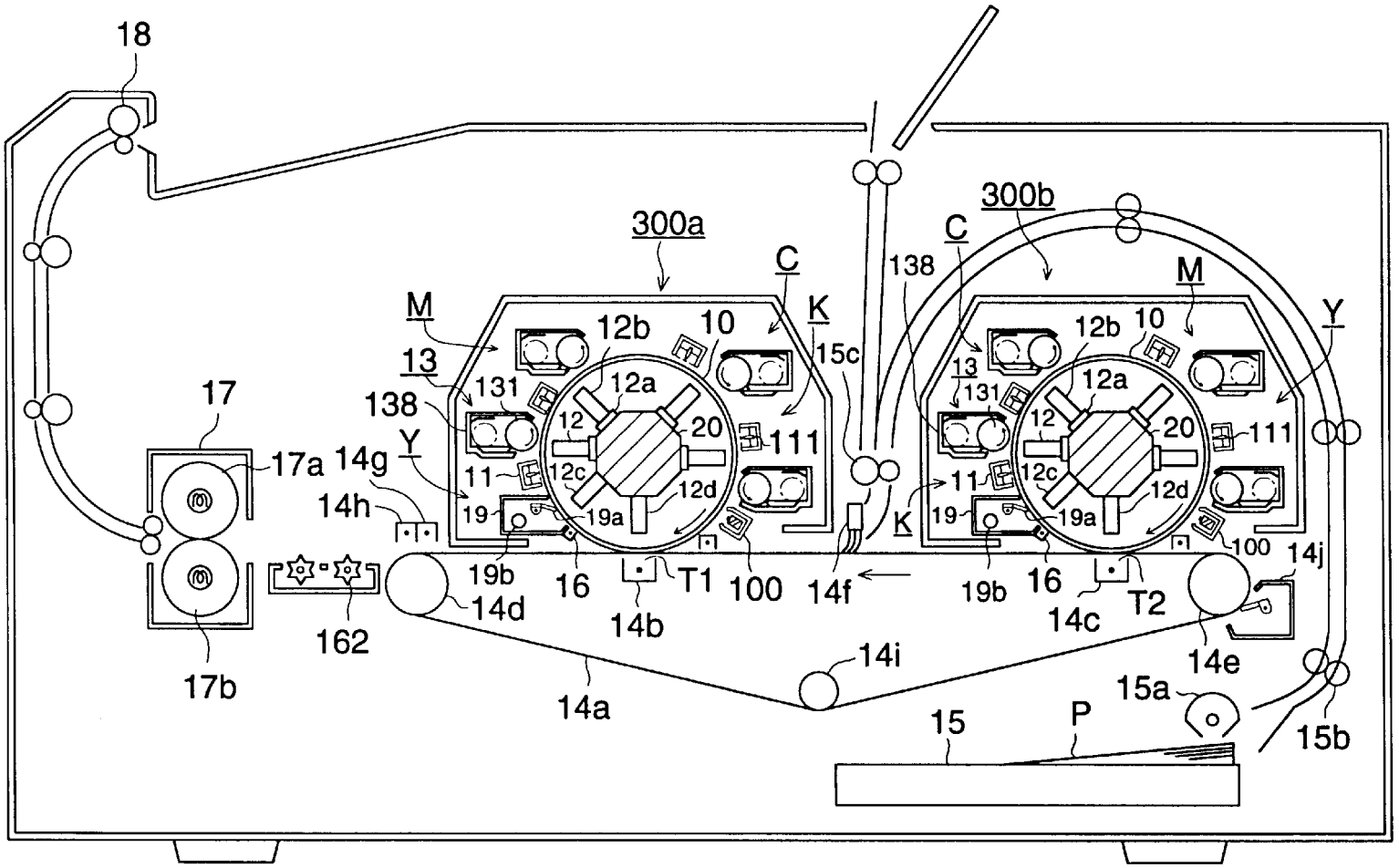
FIG. 1 is a structural sectional view of a color printer as a color image forming apparatus showing a first example of a two-sided color image forming apparatus of the present invention.
Figure 2:
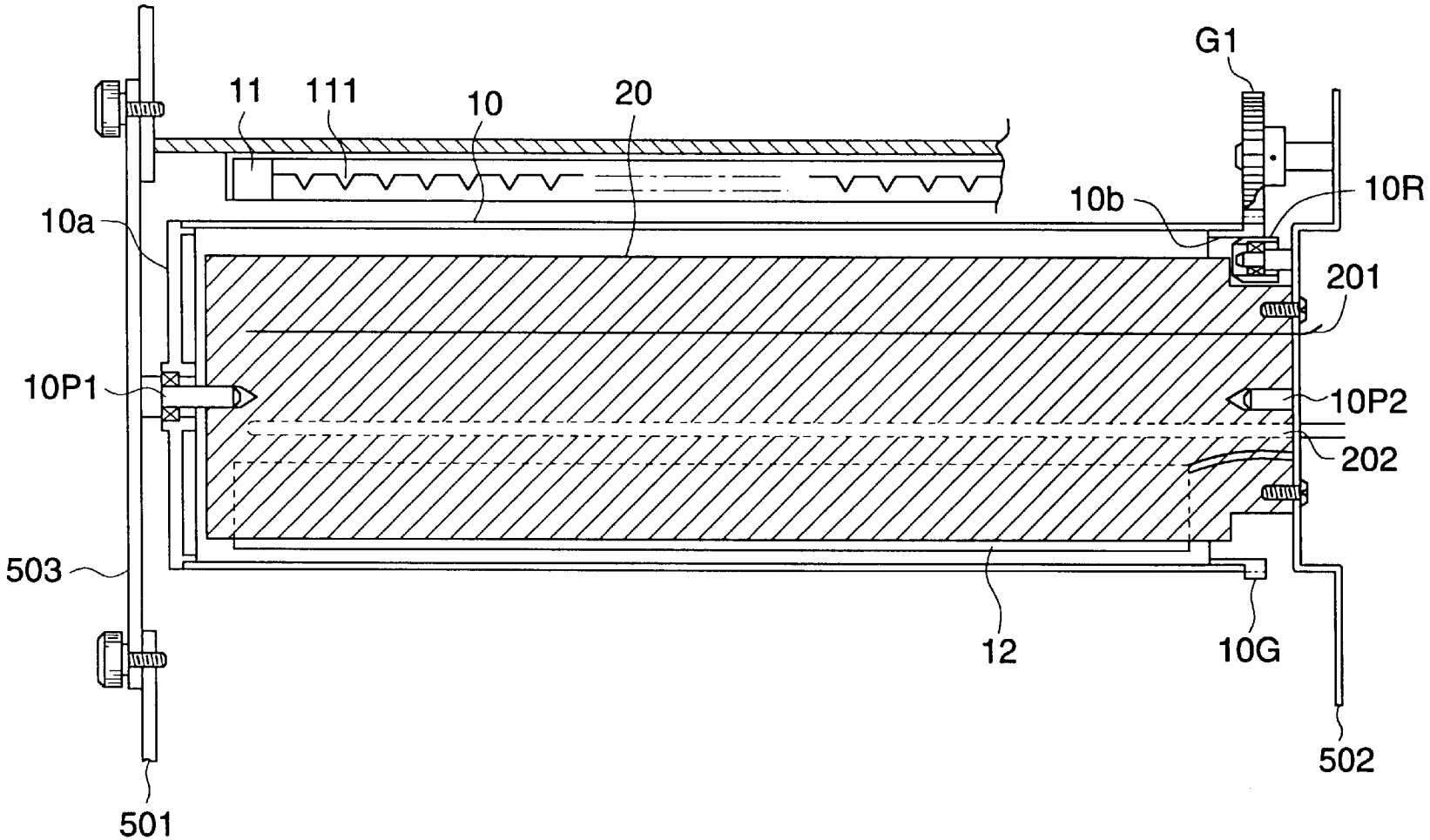
FIG. 2 is a side sectional view of an image carrier in FIG. 1.
Figure 3:
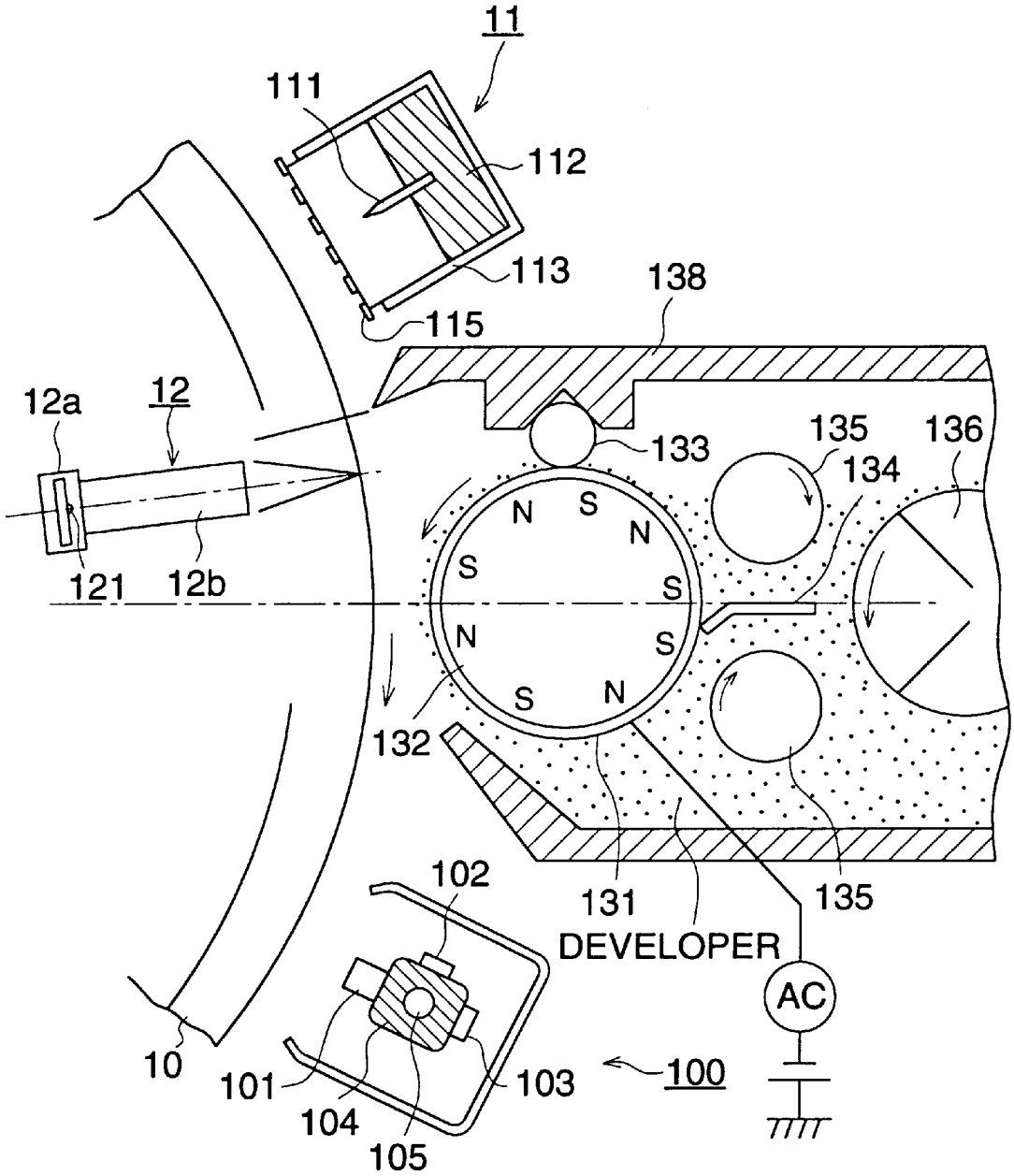
FIG. 3 is a view showing a state of potential voltage Am measurement in an enlarged view of a main portion in FIG. 1.
Figure 4:
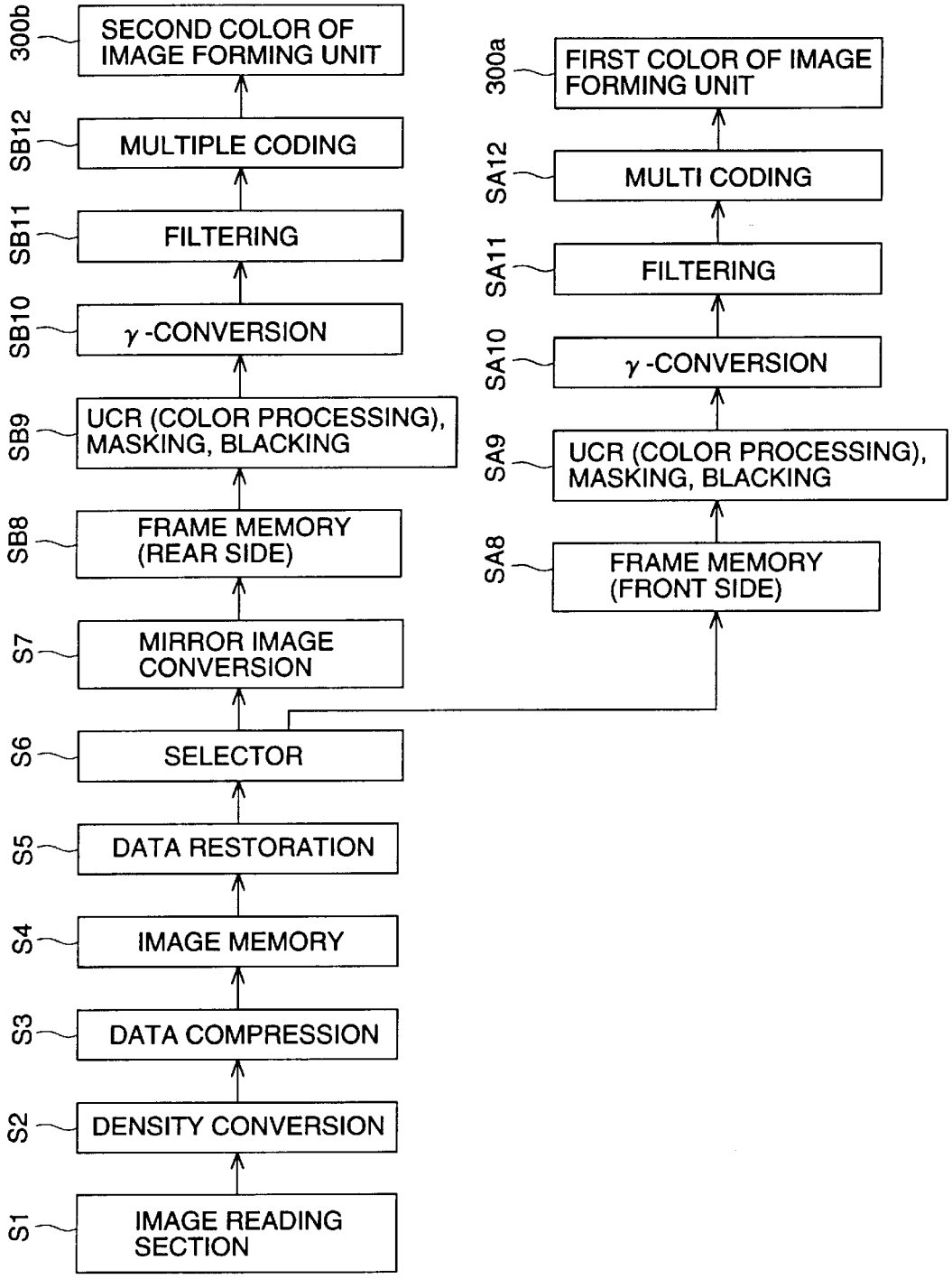
FIG. 4 is a view showing an example of a digital image processing system for color reproduction.

Referring to FIGS. 1 through 4, an image forming process and each mechanism of the first example of the two-sided image forming apparatus of the present invention will be described below. FIG. 1 is a structural sectional view of a color printer as a color image forming apparatus showing the first example of a two-sided image forming apparatus of the present invention, and FIG. 2 is a side sectional view of an image carrier in FIG. 1, FIG. 3 is an enlarged view of a main portion in FIG. 1 and shows a state of potential measurement, and FIG. 4 is a view showing an example of a digital image processing system for color reproduction.

According to FIGS. 1 to 3, a first color image forming unit 300*a* for the front side image formation in which a photoreceptor drum 10 serving as an image carrier, and a scorotron charger 11 serving as a charging means and a color developing unit 13, which are arranged around the external periphery of the photoreceptor drum 10, and an exposure unit 12 which is arranged along the inner periphery of the photoreceptor drum, are arranged in the order of yellow (Y), magenta (M), cyan (C), black (K) (Y, M, C, and K) from the upstream side in the rotational direction of the photoreceptor drum 10 in the order of processes of charging, exposing, and developing for each color; and a second color image forming unit 300*b* for the rear side image formation in which the scorotron charger 11, the exposure unit 12 and the color developing unit 13 are arranged around the photoreceptor drum 10 in the order of K, C, M, and Y from the upstream side in the rotational direction of the photoreceptor drum 10 for each color, are provided on an intermediate transfer belt 14*a* which serves as an intermediate transfer body, and is stretched in contact with or in the close proximity to the respective photoreceptor drums 10. A cleaning unit 19 serving as a cleaning means for the image carrier, and a sensor unit 100, which will be described later, other than the above devices, are respectively provided in the first and second color image forming units 300*a*. and 300*b*. The first color image forming unit 300*a* is arranged on the downstream side and the second color image forming unit 300*b* are arranged on the upstream side in the moving direction of the intermediate transfer belt 14*a* in parallel with each other.

The photoreceptor drum 10 serving as the image carrier provided in the first and second color image forming units 300*a* and 300*b* is provided inside with a cylindrical substrate formed of a transparent member of, for example, glass or transparent acrylic resin, and a transparent conductive layer, a photoreceptor layer such as an a-Si layer, or organic photoreceptor layer (OPC), etc., is formed on the outer periphery of the cited substrate.

The photoreceptor drum 10 is mounted between a front flange 10*a* and a rear flange 10*b*; the front flange 10*a* is pivoted by a guide pin 10P1 provided on a cover 503, attached to a front side plate 501 of the apparatus main body; the rear flange 10*b* is engaged on the outer surface of a plurality of guide rollers 10R, provided on a rear side plate 502 of the apparatus main body; and thereby the photoreceptor drum 10 is held. A gear 10G, provided on the outer periphery of the rear flange 10*b*, is engaged with a driving gear G1, and by its driving power, the photoreceptor drum 10 is rotated clockwise as shown by an arrow in FIG. 1, while the transparent conductive layer is electrically grounded.

In the present example, the transparent substrate may have only an amount of exposure, which can form an appropriate contrast on a light conductive layer of the photoreceptor drum. Accordingly, it is not necessary that the light transparency factor of a transparent substrate of the photoreceptor drum be 100%, but may have a characteristic in which some amount of light is absorbed at the time of transmission of the exposure beam. As light transmissive substrate materials, acrylic resins, specifically, polymers incorporating a methyl methacrylate monomer, are excellent for the transparency, strength, accuracy, surface property, etc., and are preferably used. Further, any type of light transmissive resins such as acryl, fluorine, polyester, polycarbonate, polyethylene terephthalate, etc., which are used for general optical members, may be used. The material may even be colored if it still has light permeability with respect to the exposure light beams. As a light conductive layer, indium, tin oxide (ITO), lead oxide, indium oxide, copper iodide, or a metallic film, in which light permeability is still maintained, and which is formed of Au, Ag, Ni, Al, etc., can be used. As film forming methods, a vacuum deposition method, an activated reaction deposition method, any type of spattering method, any type of CVD method, any dip coating method, any spray coating method, etc., can be used. As light conductive layers, an amorphous silicon (a-Si) alloy photoreceptor layer, an amorphous selenium alloy photoreceptor layer, or any type of organic photoreceptor layer (OPC), can be used.

A scorotron charger 11, which is a charging means, provided in the first and second color image forming units 300*a* and 300*b*, is used for image forming processes of each color of yellow (Y), magenta (M), cyan (C) and black (K). The charger is mounted in the direction perpendicular to the moving direction of the photoreceptor drum 10 which is an image carrier, and opposed to the photoreceptor drum 10; and it charges (negative charging in the present example) the organic photoreceptor layer on the photoreceptor drum 10 by a corona discharge with the same polarity as the toner, by using a control grid 115 having a predetermined potential voltage and, for example, a saw tooth type electrode as a corona discharge electrode 111, so that a uniform potential voltage is applied onto the photoreceptor drum 10. As the corona discharge electrode 111, a wire electrode can also be used instead of the above cited electrode.

As shown in FIG. 3, the scorotron charger 11 is structured as follows: a C-shaped side plate 113, which is a shielding member, and the saw-toothed corona discharge electrode 111, are attached onto the support member 112; and a control grid 115 is attached onto the support member 112, opposed to the corona discharge electrode 111.

An exposure unit 12, as an imagewise exposure means for each color, provided in the first and second color image forming units 300*a* and 300*b*, is arranged in such a manner that the exposure position on the photoreceptor drum 10 is set upstream in the rotational direction of the photoreceptor drum with respect to a developing sleeve 131, between the corona discharge electrode 111 of the scorotron charger 11 and the developing position of a color developing unit 13.

An exposure unit 12 is structured as a unit for the exposure, in which a linear exposure element 12*a*, in which a plurality of LEDs (light emitting diodes) 121 as a light emitting element for imagewise exposure lights are arrayed, and a Selfoc lens 12*b* as a life-sized image forming element, are attached onto a holder (not shown), wherein the LEDs and the Selfoc lens are arranged in the primary scanning direction parallel to the axis of the photoreceptor drum 10. The exposure unit 12 for each color, a uniform exposure unit 12*c* and a transfer-simultaneous exposure unit 12*d* are attached onto a cylindrical holding member 20 which is fixed by being guided by a guide pin 10P2, provided on a rear side plate 502 of the apparatus main body, and another guide pin 10P1, provided on a cover 503 attached on a front side plate 501, and it is accommodated inside the substrate of the photoreceptor drum 10. Image data for each color, which has been read by an image reading apparatus, provided separately from the apparatus main body, and stored in a memory, is sequentially read from the memory and respectively inputted into the exposure unit 12 for each color as electrical signals.

As the exposure elements, a linear exposure element in which a plurality of light emitting elements such as Fls (fluorescent material emission elements), Els (electroluminescence elements), PLs (plasma discharge elements), LEDs (light emitting diodes), etc., are aligned array-like, is used other than the above-described elements. The wavelength of light emission of the light emitting elements used in the present example is preferable in the range of 680–900 nm, in which the permeability of Y, M, C toners is normally high. However, because imagewise exposure is carried out from the rear surface of the photoreceptor drum, the shorter wavelength, which has insufficient transparency for color toner, may be used.

The color developing units 13, which are developing means for each color, provided in the first and second color image forming units 300*a* and 300*b*, respectively accommodate one-component or two-component developers for yellow (Y), magenta (M), cyan (C) and black (K) in a development casing 138, and are provided with developing sleeves 131, formed of, for example, cylindrical non-magnetic stainless steel or aluminum material of 0.5–1 mm thickness, and of 15–25 mm outer diameter, developing sleeves being respectively rotated in the same direction as the photoreceptor drum 10 at the developing position, while keeping a predetermined gap with respect to the peripheral surface of the photoreceptor drum 10. As shown in FIG. 3, a fixed magnet 132 is included in the developing sleeve 131; N and S magnetic poles are alternately arranged and coaxially fixed with the developing sleeve 131, and exert magnetic force onto the peripheral surface of the non-magnetic sleeve. A thin layer forming rod 133 as a thin layer forming member, is one which regulates the layer thickness of the two-component developer on the peripheral surface of the developing sleeve 131, is made of a metallic material of a circular section of a magnetic body having 3–10 mm diameter, and is in uniform pressure contact with the peripheral surface of the developing sleeve 131 with a predetermined load. A scraper 134, which removes the two-component developer from the developing sleeve 131, is made of a plate-like elastic member such as, for example, SUS, urethane rubber, etc., provided such that one edge of length of the strip is in pressure contact with the developing sleeve 131 and in parallel to it. Stirring screws 136 is rotated with the same speed, and stirs and mixes toner and carrier in the color developing unit 13 to form the two-component developer uniformly including a predetermined toner component. Further, the two-component developer is supplied to a stirring section, and is conveyed and supplied from the stirring section to the developing sleeve 131, by a supply roller 135.

The color developing unit 13 is maintained to be in non-contact with the photoreceptor drum 10 by a roller, not shown, while keeping a predetermined gap, for example, of 100–1000 $\mu$m. At a developing operation by the color developing unit 13 for each color, a developing bias voltage of a DC voltage, or further an AC voltage AC in addition to the DC voltage, is applied on the developing sleeve 131; jumping development is carried out by the one-component or two-component developer accommodated in the color developing unit; a DC bias voltage having the same polarity as the toner (negative polarity in the present example), is applied on the negatively charged photoreceptor drum 10 in which a transparent conductive layer is electrically grounded; and non-contact reversal development is carried out to adhere toner onto the exposure section. An accuracy of the developing gap at the time is required to be smaller than about 20 $\mu$m to prevent image unevenness.

The color developing unit 13 for each color reversal-develops an electrostatic latent image on the photoreceptor drum 10, which is formed by charge of the scorotron charger 11 and imagewise exposure by the exposure unit 12, in a no-contact condition, by the non-contact development method by application of a development bias voltage, by using toner having the same polarity as the charged polarity (in the present example, the photoreceptor drum is negatively charged, and the polarity of toner is also negative).

As shown in FIG. 3, a sensor unit 100, provided in the first and second color image forming units 300*a* and 300*b*, is composed of a potential voltage sensor 101 attached to a sensor attaching member 104 which is rotatable around the support shaft 105, a reflection density sensor 102 using infrared rays for Y, M and C, and a reflection density sensor 103 for K. Further, as shown in FIG. 1, in the first color image forming unit 300*a*, the sensor 100 is arranged downstream of the color developing unit 13 for K, which is located at the most downstream position in the rotational direction of the photoreceptor drum 10, in the color developing units for Y, M, C, K, which are a plurality of developing means arranged in the sequence of toner image formation. In the second color image forming unit 300*b*, the sensor 100 is arranged downstream of the color developing unit 13 for Y, which is located at the most downstream position in the rotational direction of the photoreceptor drum 10, in the color developing units 13 for K, C, M, Y, which are a plurality of developing means arranged in the sequence of toner image formation.

The infrared rays is used for the reason that Y, M and C toners respectively have a high spectral reflection factor in the infrared range, and therefore it can be used in common. Further, K toner has a low reflection factor in the infrared range when carbon system color materials are used, and therefore, it is not used in common. Of course, when K toner is made of a color material having high spectral reflection factor in the infrared range, it can be used with the other toners.

Regarding the sensor unit 100, the potential voltage sensor 101, the reflection density sensor 102 for Y, M, C, and the reflection density sensor 103 for K are arranged under the condition that they are not opposed to the photoreceptor drum 10 surface and are withdrawn from the drum surface during the color image formation.

The rear side image formation process by the second color image forming unit 300*b* will be described below.

When image recording starts, a photoreceptor driving motor, not shown, is started and a gear 10G provided on the rear flange 10*b* of the photoreceptor drum 10 is rotated through a gear G1 for driving, and the photoreceptor drum 10 is rotated clockwise shown by an arrow in FIG. 1. Simultaneously, potential voltage application onto the photoreceptor drum 10 is started by the charging operation of the scorotron charger 11 for K.

After the potential voltage has been applied onto the photoreceptor drum 10, exposure is started by the K exposure unit 12 according to electric signals corresponding to the first color signal, that is, K image data, and by the rotational scanning of the drum, an electrostatic latent image corresponding to an image of K of the document image is formed on the photoreceptor layer on the surface of the drum.

The latent image is reversal-developed by the K color developing unit 13 under the condition that developer on the developing sleeve is in no-contact with the latent image, and a black (K) toner image is formed corresponding to the rotation of the photoreceptor drum 10.

Next, potential voltage is further applied onto the black (K) toner image on the photoreceptor drum 10 by a charging operation of the scorotron charger 11 for cyan (C), exposure is carried out according to an electric signal corresponding to the second color signal of the C exposure unit 12, that is, C image data, and a cyan (C) toner image is formed by being successively superimposed on the black (K) toner image by non-contact reversal development of the color developing unit 13 for C.

By the same process, a magenta (M) toner image corresponding to the third color signal is further formed by successive superimposition on the former toner images, by the magenta (M) scorotron charger 11, M exposure unit 12 and M color developing unit 13, and a yellow (Y) toner image corresponding to the fourth color signal is further formed by successive superimposition on the former toner images, by the yellow (Y) scorotron charger 11, Y exposure unit 12 and Y color developing unit 13, and then, a color toner image is formed on the peripheral surface of the photoreceptor drum 10 during its one rotation.

Exposure onto the organic photoreceptor layer on the photoreceptor drum 10 by these K, C, M and Y exposure units 12 is carried out from inside the drum through the transparent substrate. Accordingly, exposure onto the image corresponding to the second, third, and fourth color signals can be carried out without entirely being influenced by the previously formed toner images, and therefore, the same electrostatic latent image as the image corresponding to the first color signal can be formed. In this connection, stabilization of temperature inside the photoreceptor drum 10 and prevention of temperature rise due to heat generation of each exposure optical system 12, can be attained to the degree of no hindrance by the following method: excellent heat conductive material is used for the holding member 20; in the case of low temperature, a heater 201 is used; and in the case of high temperature, heat is dissipated to the outside through a heat pipe 202.

By the above-described image formation process, superimposed color toner images, which form a rear side image, are formed on the photoreceptor drum 10 serving as the image carrier, provided in the second color image forming unit 300*b*; the superimposed color toner images for the rear side image on the photoreceptor drum 10 in the second color image forming unit 300*b* are collectively transferred onto an intermediate transfer belt serving as the intermediate transfer body, which is stretched around a driving roller 14*d*, driven roller 14*e*, and tension roller 14*i*, and provided in close proximity to or in contact with respective photoreceptor drums 10 in the first and second color image forming units 300*a* and 300*b*, by a transfer unit 14*c* onto which voltage with the reverse polarity to the toner (in the present example, positive polarity) is applied, in a transfer area T2 of the second color image forming unit 300*b*. In this case, in order to conduct excellent transferring, uniform exposure is conducted by a transfer-synchronous exposure unit 12*d* using, for example, light emitting diodes.

Toner remaining on the peripheral surface of the photoreceptor drum 10 in the second color image forming unit 300*b* after transfer is discharged by an image carrier AC discharger 16, then, comes to a cleaning unit 19 serving as a cleaning means for the image carrier, and is scraped off into the cleaning unit 19 by a cleaning blade 19*a* made of rubber material in contact with the photoreceptor drum 10, and collected in a waste toner container, not shown, by a screw 19*b*. Further, in order to eliminate hysteresis of the photoreceptor up to the former printing, the peripheral surface of the photoreceptor is discharged by exposure by a pre-charging uniform exposure unit 12*c* using, for example, light emitting diodes, electrical charge at the former printing is eliminated, and then the photoreceptor is charged by the K scorotron charger 11, and sequentially, the next rear side color image formation is carried out.

In the manner as described above, the color image formation by the second color image formation unit 300*b* is carried out.

The first color image forming unit 300*a* is in timed relationship with the rear side image formed on the intermediate transfer belt 14*a* by the second color image forming unit 300*b*, in the transfer area T1; the sequence of charging, exposing, and developing of the first color image forming unit 300*a* is entirely reversed to the sequence of K, C, M and Y toner image formation formed of black toner and color toners in the case of rear side color image formation; and superimposed color toner images of Y, M, C, K of the front side image are formed on the photoreceptor drum 10 of the first color image forming unit 300*a* by four sets of each color scorotron charger 11, exposure unit 12 and color developing unit 13 in the same manner as the cited color image forming process in the order of yellow(Y), magenta (M), cyan (C) and black (K) (Y, M, C and K). It is necessary to change image data so that the front side image by the first color image forming unit 300*a* formed in this case, is formed to be a mirror image of the rear side image formed on the photoreceptor drum 10 of the second color image forming unit 300*b*, on the photoreceptor drum 10 of the first color image forming unit 300*a*.

The recording sheet P, which is a transfer material, is sent from a sheet feed cassette 15, which is a recording sheet accommodating means, by a sheet sending roller 15*a*, fed by a sheet feeding roller 15*b*, and is conveyed to a timing roller 15*c* located between the first color image forming unit 300*a* and the second color image forming unit 300*b*.

The front side color toner image carried on the photoreceptor drum 10 of the first color image forming unit 300*a* is in timed relationship with the rear side color toner image carried on the intermediate transfer belt 14*a*, and the recording sheet P is sent to the transfer area T1 of the first color image forming unit 300*a* by the drive of the timing roller 15*c*. In this case, the recording sheet P is paper-charged to the same polarity as toner by a paper-charger 14*f*, and is attracted to the intermediate transfer belt 14*a* and sent to the transfer area T1. By paper-charging the recording sheet P to the same polarity as toner, the recording sheet P is prevented from being attracted to the toner image of the rear side image on the intermediate transfer belt 14*a* or the toner image of the front side image on the photoreceptor drum 10 of the first color image forming unit 300*a*, thereby, the toner image is prevented from being disturbed.

By a front side transfer unit 14*b* which applies the voltage having reverse polarity to toner (in the present example, positive polarity), front side images on the peripheral surface of the photoreceptor drum 10 in the first color image forming unit 300*a* are collectively transferred onto the upper surface side of the recording sheet P. In this case, the rear side images on the peripheral surface of the intermediate transfer belt 14*a* are not transferred onto the recording sheet P, but exist on the intermediate transfer belt 14*a*. Next, the rear side images on the surface of the intermediate transfer belt 14*a* are collectively transferred onto the lower surface side of the recording sheet by a rear side transfer unit 14*g* which applies the voltage having reverse polarity to toner (in the present example, positive polarity). In the case of transfer by the front side transfer unit 14*b*, uniform exposure is carried out so that excellent transfer is carried out, by a transfer-synchronous exposure unit 12*d* using, for example, light emitting diodes, which is provided inside the photoreceptor drum 10 in the first color image forming unit 300*a*, and is opposed to the front side transfer unit 14*b*.

Because toner images of each color are superimposed each other, in order to enable the collective transferring, it is preferable that the upper layer toner and the lower layer toner in the toner layer are charged with the same charging amount and the same polarity. According to this, in the two-sided image formation in which the polarity of the color toner image formed on the intermediate transfer belt 14*a* is reversed by corona charging, or the polarity of the color toner image formed on the photoreceptor drum 10 of the second color image forming unit 300*b* is reversed by corona charging, the toner of the lower layer is not sufficiently charged to the same polarity, resulting in transfer failure, which is not preferable.

It is preferable for attribution to an increase of transfer property of the rear side image formation that color toner images having the same polarity which are reversal-developed on the photoreceptor drum of the second color image forming unit 300*b* and formed by superimposition, are collectively transferred onto the intermediate transfer belt 14*a* without changing the polarity, and next, collectively transferred onto the recording sheet without changing the polarity. Also for the front side image formation, it is preferable for attribution to an increase of transfer property of the front side image formation that color toner images having the same polarity which are reversal-developed on the photoreceptor drum of the first color image forming unit 300*a* and formed by superimposition, are collectively transferred onto the recording sheet P without changing the polarity.

Due to the foregoing, in the color image formation, the following two-sided image forming method is preferably adopted in which, by using the cited front and rear image forming method, a color toner image is formed on the front side of the recording sheet by the operation of the front side transfer unit 14*b*, and next, a color toner image is formed on the rear side of the recording sheet by the operation of the rear side transfer unit 14*g*.

The intermediate transfer belt 14*a* is an endless rubber belt having the thickness of 0.5 to 2.0 mm, and has two layer construction including a semi-conductive silicon rubber or urethane rubber base body having the resistance value of $10^8$ to $10^{12}$ Ω·cm, and a rubber base body on the outside of which 5 μm to 50 μm thick fluorine coating is conducted as a toner filming prevention layer. This layer has preferably similar semiconductive property. Instead of the rubber belt base body, 0.1 to 0.5 mm thick semi-conductive polyester, polystyrene, polyethylene, or polyethylene terephthalate may be used.

The recording sheet P on both sides of which color toner images are formed, is discharged by a paper separation AC discharger 14*h* for recording sheet separation, separated from the intermediate transfer belt 14*a*, and through a spurred wheel 162 to prevent the frictional damage of the toner image of the rear side image on the recording sheet P, it is conveyed to the fixing unit 17 serving as a fixing means, which is structured by two rollers each having a heater therein. The toner adhered onto the front and rear sides of the recording sheet P is fixed by the application of heat and pressure between a fixing roller 17*a* and a pressure-contact roller 17*b*, thereby, the recording sheet P on both sides of which images are recorded is reversed upside down and conveyed to the delivery sheet roller 18, and is delivered onto a tray outside the apparatus.

Toner remaining on the peripheral surface of the intermediate transfer belt 14*a* after transfer is cleaned by an intermediate transfer body cleaning unit 14*j*. Toner remaining on the peripheral surface of the photoreceptor drum 10 of the first color image forming unit 300*a* after transfer is discharged by an image carrier AC discharger 16, then, comes to a cleaning unit and is scraped down into the cleaning unit 19 by a cleaning blade 19*a* made of rubber material in contact with the photoreceptor drum 10, and collected in a waste toner container, not shown, by a screw 19*b*. Then the photoreceptor drum 10 of the first color image forming unit 300*a* whose remaining toner is removed by a cleaning unit 19 is uniformly charged by the Y scorotron charger 11, and enters the next front side image formation cycle.

The above-cited color image formation in the color printer is carried out, as shown in FIG. 4, by the control of image data processing conditions in a digital image processing section by S1 to SB12 for the rear side image, and S1 to SA12 for the front side image; and the control of image forming process conditions of the charging means, imagewise exposure means, and developing means corresponding to the rear side image or the front side image in the second color image forming unit 300*b* for the rear side image, and in the first color image forming unit 300*a* for the front side image.

Because, when the rear side image is transferred from the image carrier onto the intermediate transfer body, and from the intermediate transfer body onto the recording sheet P, the toner adhering amount is lowered by about 10% for each case, the image density of the rear side image is lower than that of the front side image in which the front side image is only transferred from the image carrier onto the recording sheet P, or the gradation of the toner image is changed by scattering (a halftone dot is spread, and generally, γ is increased) due to two-time transfer. Further, in the color image, the sequence of superimposition of toner images is made the same on the recording sheet P so that the change of color tone is small, however, the color tone is changed thereby. Therefore, the toner adhering amount of the rear side image is increased when the image is formed, or in order to adjust the color tone, the following processing is conducted corresponding to each of the first and second color image forming units 300*a* and 300*b*: the charging potential is changed by measurement by the potential sensor, or the process condition such as the imagewise exposure light or developing condition is changed corresponding to each of the cases of the front side image formation and the rear side image formation.

As a document image, an image read by an image pick-up element of an image reading apparatus separately provided from the present apparatus, or an image edited by a computer, is compressed as image data for each color of K, C, M, Y, and temporarily stored in a memory.

In an image signal processing system in the image processing section, an image signal from an image reading section S1 composed of a CCD sensor, an A/D converter, and a shading correction circuit, is density-converted from the BGR signal system image data into the YMC system image data (S2). All image data are stored in an image memory S4 after data compression (S3). The image data successively read from the image memory S4 according to the output command, is data restoration-processed, then, is divided into the image data to be formed by the second color image forming unit 300*b*, that is, the image data of the rear side image, and the image data to be formed by the first color image forming unit 300*a*, that is, the image data of the front side image, by the selector S6. The image data of the front side image is stored in a frame memory SA8 without any additional processing, however, the image data of the rear side image is mirror image-processed to reverse the left and right of the image (S7), and then, stored in a frame memory SB8. Each of frame memories SA8 and SB8 respectively has a memory for two image areas, and the memory for one image area is alternately used for development of the cited image data, and the other memory for one image area is alternately used for the output of image data.

The image data from the frame memory SA8 is inputted into the first color image forming unit 300*a* through image processing corresponding to the front side image, such as parameter setting for color correction shown in a masking processing section SA9, γ conversion (SA10), filtering (SA11), and multi-coding (SA12), and the image data from the frame memory SB8 is inputted into the second color image forming unit 300*b* through image processing corresponding to the rear side image, such as parameter setting for color correction shown in a masking processing section SB9, γ conversion (SB10), filtering (SB11) such as MTF correction, and multi-coding (SB12).

In an example described below, the potential sensor sequentially measures a plurality of potential patterns made by a plurality of charging means for Y, M, C and K (in the case of the rear side image, K, C, M and Y) and the corresponding imagewise exposure means, at one position, and controls the charging potential of Y, M, C, and K and a light amount of the imagewise exposure light (in the case of the rear side image, the charging potential of K, C, M and Y, and the light amount of the imagewise exposure light). After the charging potential of the charging means of Y, M, C, K (in the case of the rear side image, K, C, M and Y), or the light amount of the imagewise exposure light of the imagewise exposure means is adjusted by the potential sensor, the reflection density sensor operates the corresponding developing means of Y, M, C, K (in the case of the rear side image, K, C, M and Y) with respect to the potential pattern of Y, M, C, and K (in the case of the rear side image, K, C, M and Y) after adjustment, and makes the toner image pattern of Y, M, C, and K (in the case of the rear side image, K, C, M and Y). By using one reflection density sensor, the reflection density of the toner image pattern of Y, M, C, and K (in the case of the rear side image, K, C, M and Y), is sequentially measured, and a γ correction table for each color is made. By using the γ correction table for each color, γ correction of image data for each color is carried out, or the reflection density of the toner image pattern of Y, M, C (in the case of the rear side image, C, M and Y) is sequentially measured, and the parameter setting for color correction for each color is carried out.

Initially, correction corresponding to the front side image will be shown.

Figure 5:
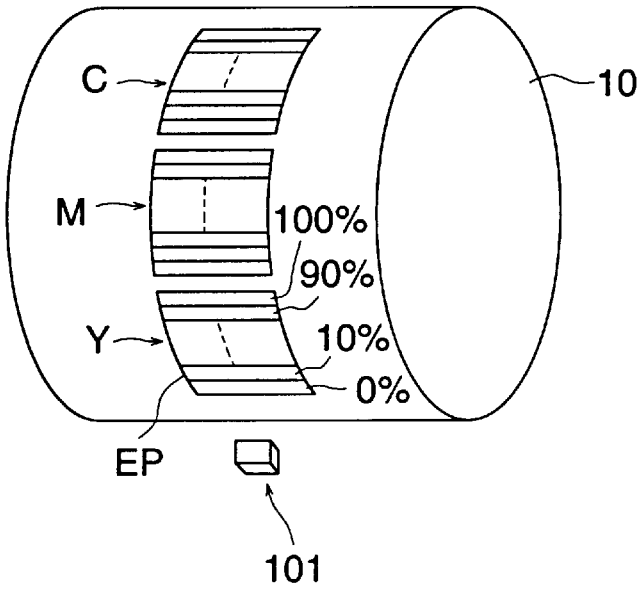
FIG. 5 is a view showing a potential pattern.
Figure 6:
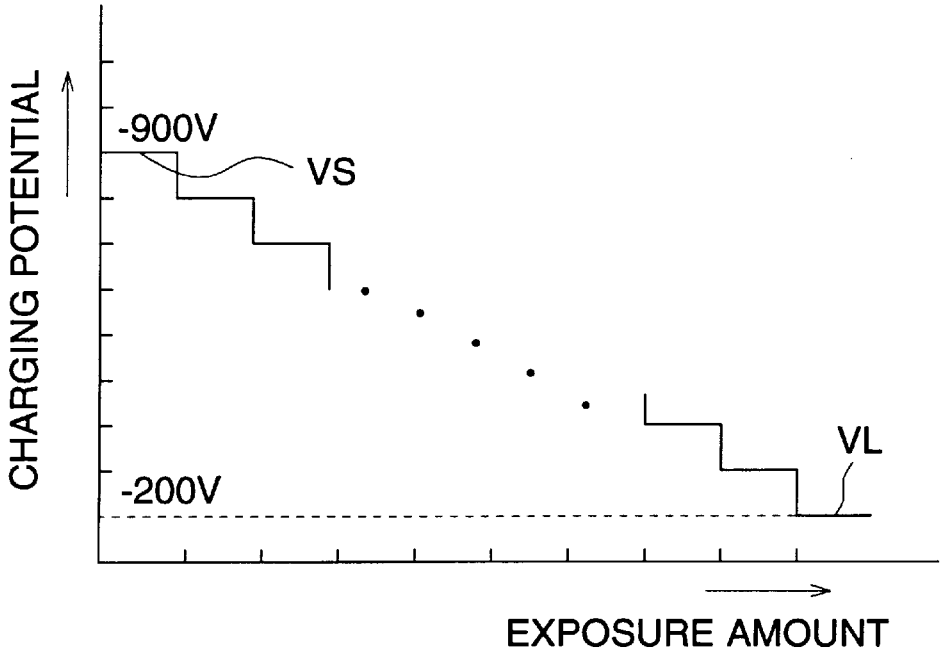
FIG. 6 is a view showing correction of the potential pattern.

Initially, referring to FIGS. 5, 6 and 3, correction of the charging potential and the light amount of the imagewise exposure light by the potential sensor will be described. FIG. 5 is a view showing the potential pattern, and FIG. 6 is a view showing correction of the potential pattern.

As described by the image forming process above, uniform charging is carried out by the scorotron charger 11. Next, exposure of 0% to 100% (the maximum output of LEDs) is carried out continuously and stepwise by, for example, every 10% step, by pulse width modulation based on the test pattern stored in the memory of the control section, not shown, by an LED 121 as the light emitting element of the exposure unit 12 provided inside the photoreceptor drum 10, and as shown in FIG. 5, the stepwise and continuous potential pattern EP is formed on the photoreceptor drum 10. By the scorotron charger 11 and exposure unit 12 for each color, the potential pattern EP for each color of Y, M, C, and K (K is not shown) is formed on the photoreceptor drum 10.

In this case, the scorotron charger 11 is not operated from the next process after the potential pattern has been formed. That is, when the potential pattern of color M is formed, only the scorotron chargers for colors Y and M are operated, and those for colors C and K are not operated. This is for the reason that, if this is not executed, the formed potential pattern is eliminated.

In this case, the potential sensor 101, provided on a sensor attaching member 104 of the sensor unit 100 located downstream of the K color developing unit 13, which is located at the most downstream position in the rotational direction of the photoreceptor drum 10, of the Y, M, C, K color developing units 13, serving as a plurality of developing means, located in the toner image forming sequence, is rotated around the support shaft 105 to the position opposing to the photoreceptor drum 10 surface.

The charging potential of the stepwise potential pattern EP for each color of Y, M, C, K formed on the photoreceptor drum 10 is sequentially measured by the potential sensor 101. The development by the color developing units 13 for each color is stopped during the potential pattern EP formation, and during the charging potential measurement of the potential pattern EP by the potential sensor 101.

As shown in FIG. 6, the potential attenuation characteristic with respect to the photoreceptor drum 10 is adjusted as follows: the maximum charging potential VS of the stepwise charging potential measured by the potential sensor 101 is set to, for example, −900 V by adjusting the grid voltage applied onto a control grid 115; and the minimum charging potential VL determined by the maximum exposure amount of the LED 121 is set to, for example, −200V by adjusting the current value of the LED 121.

The maximum exposure amount of the LED 121 to set the minimum charging potential VL is adjusted at a value of, for example, 80% or 60% of the maximum output of the LED 121. The potential attenuation characteristic is set for each color by the grid voltage adjustment by the control grid 115 and the current value adjustment of the LED 121.

In the above description, the potential attenuation characteristic can also be set for each color by the adjustment of the development bias voltage applied onto the color developing unit 13 or the number of rotations of the development sleeve, instead of the adjustment of the charging potential and exposure amount.

Figure 7:
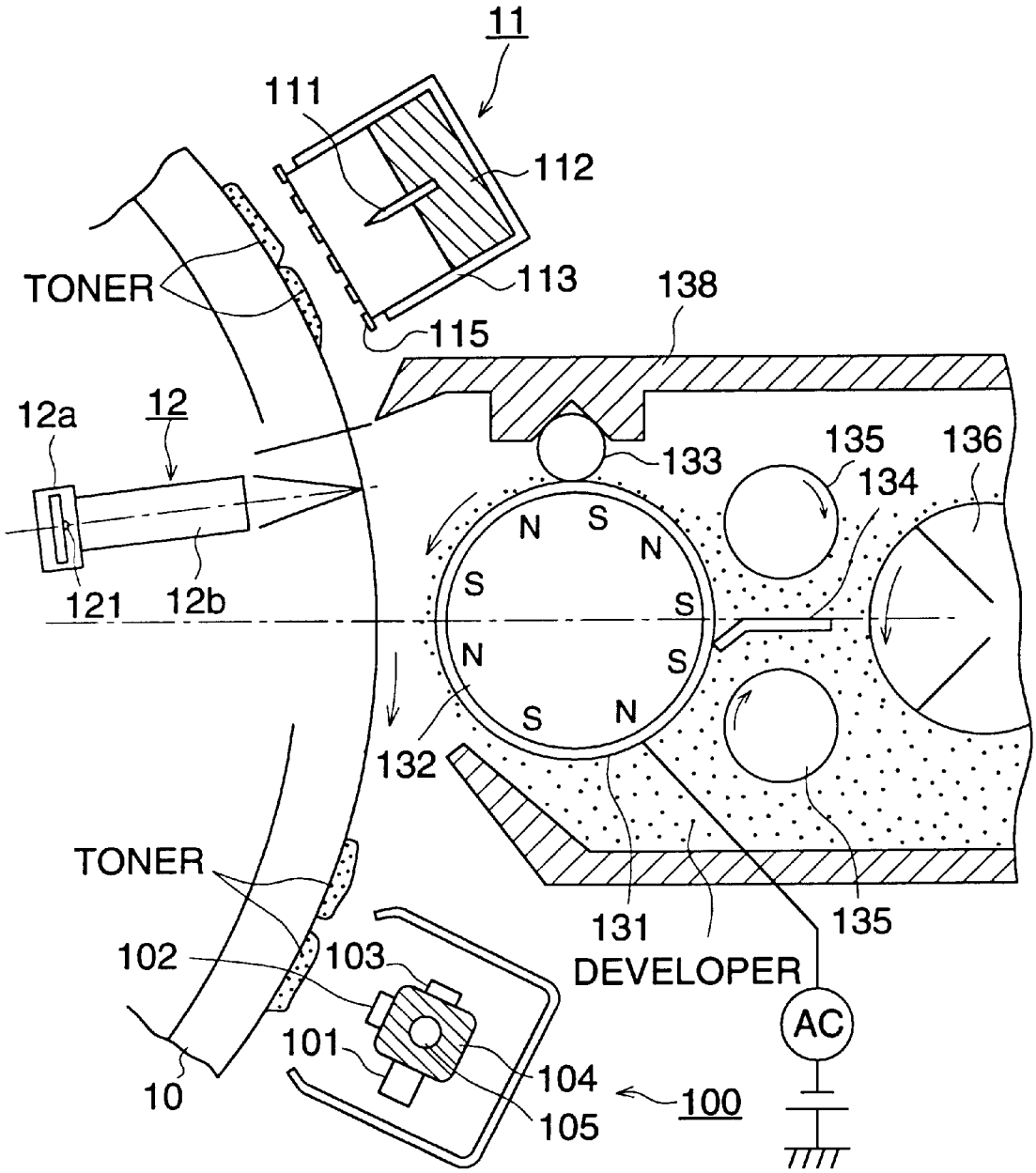
FIG. 7 is an enlarged view of a main portion in FIG. 1, and shows a state of reflection density measurement.
Figure 8:
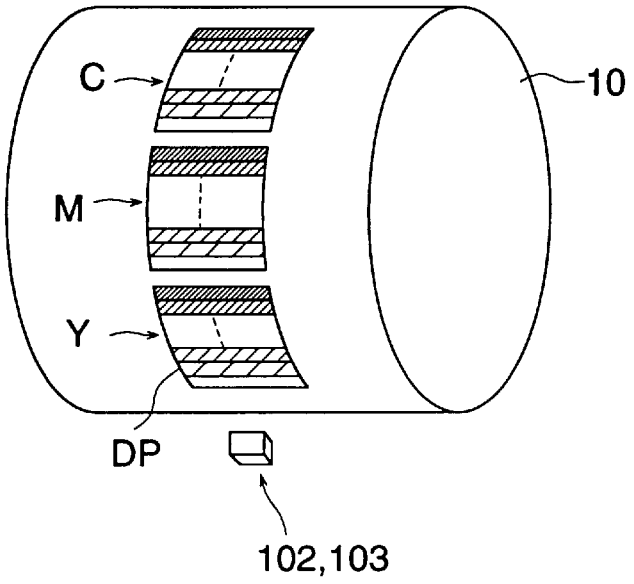
FIG. 8 is a view showing a toner image pattern.
Figure 9:
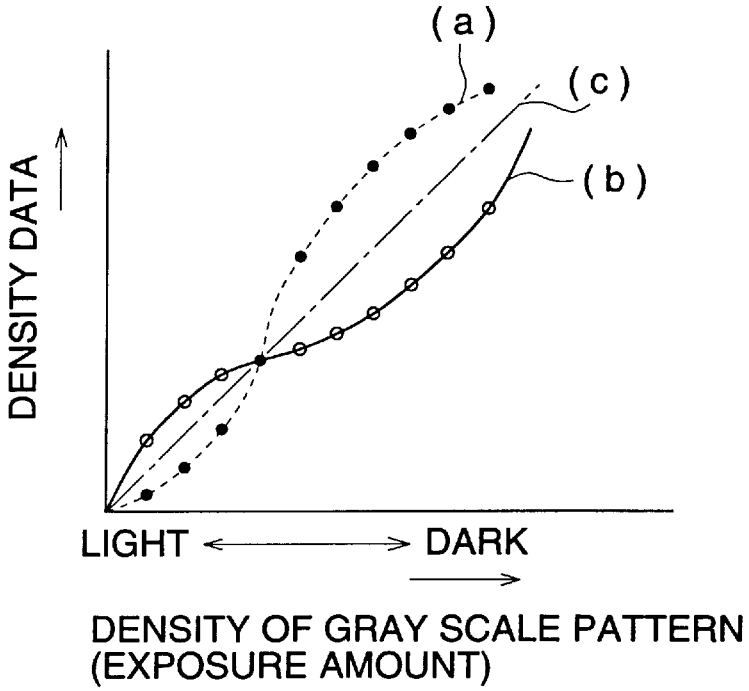
FIG. 9 is a view for explaining γ-correction.

Next, referring to FIGS. 7 through 9, production of the γ correction table used in the case of the image data output will be described. FIG. 7 is an enlarged view of the main portion of FIG. 1, and is a view showing the state at the time of reflection density measurement. FIG. 8 is a view showing the toner image pattern. FIG. 9 is a view explaining the γ-correction.

The corrected potential pattern (gray scale pattern), which is stepwise and continuous, is formed on the photoreceptor drum 10 uniformly charged by the scorotron charger 11, by using the pulse width modulation output in which the maximum exposure amount set to, for example, 80% of the maximum output of the LED 121 is divided, for example, by 10, by the above cited charging potential adjustment. Next, the color developing unit 13 is activated, the gray scale pattern is developed, and the toner image pattern DP is made. The toner image pattern DP for each color of Y, M, C, K (k is not shown), shown in FIG. 8, is formed on the photoreceptor drum 10 by the scorotron charger 11, exposure unit 12 and color developing unit 13 for each color. This toner image pattern forming process is the same as the normal color image forming process, in which only the latent image forming pattern is changed.

In this case, the reflection density sensor 102, provided on a sensor attaching member 104 of the sensor unit 100 located downstream of the K color developing unit 13, which is located at the most downstream position in the rotational direction of the photoreceptor drum 10, of the Y, M, C, K color developing units 13, serving as a plurality of developing means, located in the toner image forming sequence, is rotated around the support shaft 105 to the position opposing to the photoreceptor drum 10 surface. By conducting the above cited operation, the potential sensor 101 can be prevented from being stained by toner.

The density data of the stepwise toner image pattern DP for each color of Y, M, C, K formed on the photoreceptor drum 10 is successively measured by the reflection density sensor 102. The relationship between the density (exposure amount) of the gray scale pattern by the pulse width modulation exposure light divided by 10 and the density data obtained by the reflection density sensor is shown by black dots in FIG. 9, and a curve (a) shown by a dotted line in which black dots are connected to each other, shows the γ characteristic of the density data of the toner image pattern. The γ-correction curve shown by a curve (b), is formed as a correction curve by obtaining the correction value (a circle mark) corresponding to the curve (a) so that the γ-characteristic coincides with a linear line (c) shown by a one-dotted chain line, that is, γ=1. Based on the γ-correction curve, the value of the density (exposure amount)of the gray scale pattern expressed by a plurality of points shown by, for example, circle marks, and the value of density data are stored in the memory of the control section, not shown, as a γ-correction table. The γ-correction table for each color of Y, M, C and K is made, and stored in the memory. Actually, γ is set to a value a little higher than 1 (as the image, relatively harder).

The reflection density sensor 103 is used, and activated while being opposed to the photoreceptor drum 10, and only the toner density pattern of black (K) is individually measured by the reflection density sensor 103, and the γ-correction table of K may be made.

As explained in FIG. 1, the image read out by the image pick-up element of the image reading apparatus separately provided from the color image forming apparatus, or the image edited by a computer is temporarily stored in the memory as the image data for each color of Y, M, C and K. The stored image data sets the exposure amount corresponding to the density data (the density of the gray scale pattern) by the corresponding γ-correction table of Y, M, C and K, according to a value of the density data of the image data for each of Y, M, C and K in the case of image recording. The LED 121 aligned array-like as the exposure element is individually activated by the pulse width modulation output in the exposure amount.

The correction of the front side image is described above. In the case of the rear side image, the color developing unit 13 of K, C, M and Y is located in the rotational direction of the photoreceptor drum 10, and the process condition (charging potential and exposure amount) or image data is corrected in the same manner as the adjustment in the front side image, by the sensor unit 100 located at the downstream of the Y color developing unit 13 which is located at the most downstream position in the rotational direction of the photoreceptor drum 10. As the correction method, in the same manner as the front side image adjustment, adjustment for the rear side image is carried out individually. As the correction at the time, the reflection density sensor is provided opposed to the toner image receiving body, and the correction is carried out by detecting the toner image formed on the toner image receiving body, thereby, the more highly accurate correction can be carried out. Alternatively, as another correction method, the following method is adopted: the correction of the process condition (charging potential and exposure amount) or image data of the rear side image is determined by presuming from experiment data previously obtained for the correction condition of the process condition (charging potential and exposure amount) or image data of the front side image. For example, because two-time correction is carried out for the front side image formation, in order to adhere the same amount of toner onto the recording sheet P, it is necessary that the toner image, previously having about 10% larger amount of toner, is formed on the photoreceptor drum 10. In the case of the rear side image formation, the adjustment condition is previously determined as follows: the maximum charging potential VS is increased by 10%; the maximum exposure amount is increased by 10%; because the half tone dot is deformed and γ is hardened by the two-time transfer, a previously laid γ-correction curve is used; or because the resolving power of the character is decreased by toner scattering by the two-time transfer, a filter correction value in which the correction by an MTF filter is previously enhanced, is used. Thereby, the adjustment is carried out so that the amount of toner is the same for the front side image and the rear side image.

Figure 10:
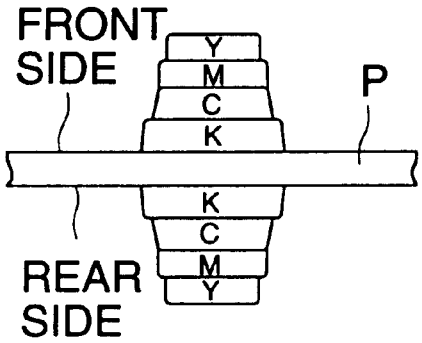
FIG. 10 is a view showing superimposed color toner images formed on the front and rear sides of the recording sheet.

Further, the superimposed color toner image which is formed on the front and rear sides of the recording sheet, is shown in FIG. 10. As shown in FIG. 10, in both of superimposed color toner images on the front and rear sides, black (K) is the lowermost, and C, M and Y are sequentially superimposed on the recording sheet (on both the front and rear sides, the superimposed color toner image is formed in the order of K, C, M, Y from the surface of the recording sheet P). In this case, because the transfer rate changes depending on each toner, the change of parameter setting for masking for color correction as shown by SA9, SB9 in FIG. 4 is required in addition to the correction of each density data, in the case of color image.

Figure 11:
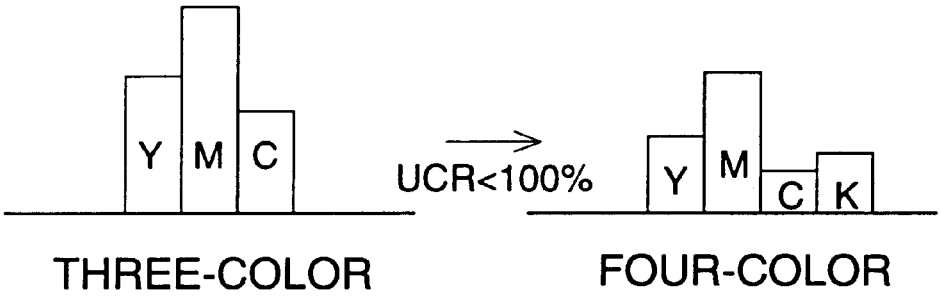
FIG. 11 is a view showing UCR.

FIG. 11 is a view showing the UCR, and generally, the UCR value is 30 to 100%, and is reproduced by four colors of three color toners and black toner, rather than reproduction by only three colors of Y, M, C. The UCR value is also appropriately changed in addition to the change of masking parameter in each of both the front side image and rear side image.

The above-cited color correction in the masking section is carried out including color processing such as masking, black printing, and UCR. As the masking, linear masking, which is generally carried out, or non-linear masking or masking using a look-up table when the higher color correction is carried out, is used.

As described above, in the case of monochromatic or color image formation by the color image forming apparatus, image formation is carried out by using the process condition and the image data processing condition set as described above, and thereby, two-sided image formation with finely adjusted image density and color tone is carried out.

Further, as a variation of the above description, by changing only one condition, the rear side image formation may be carried out. Specifically, in the case of the monochromatic image formation, the color correction is not necessary, and if the maximum density of black is the saturated image density, a sufficient level image can also be reproduced even by only gradation correction.

EXAMPLE 2

Figure 12:
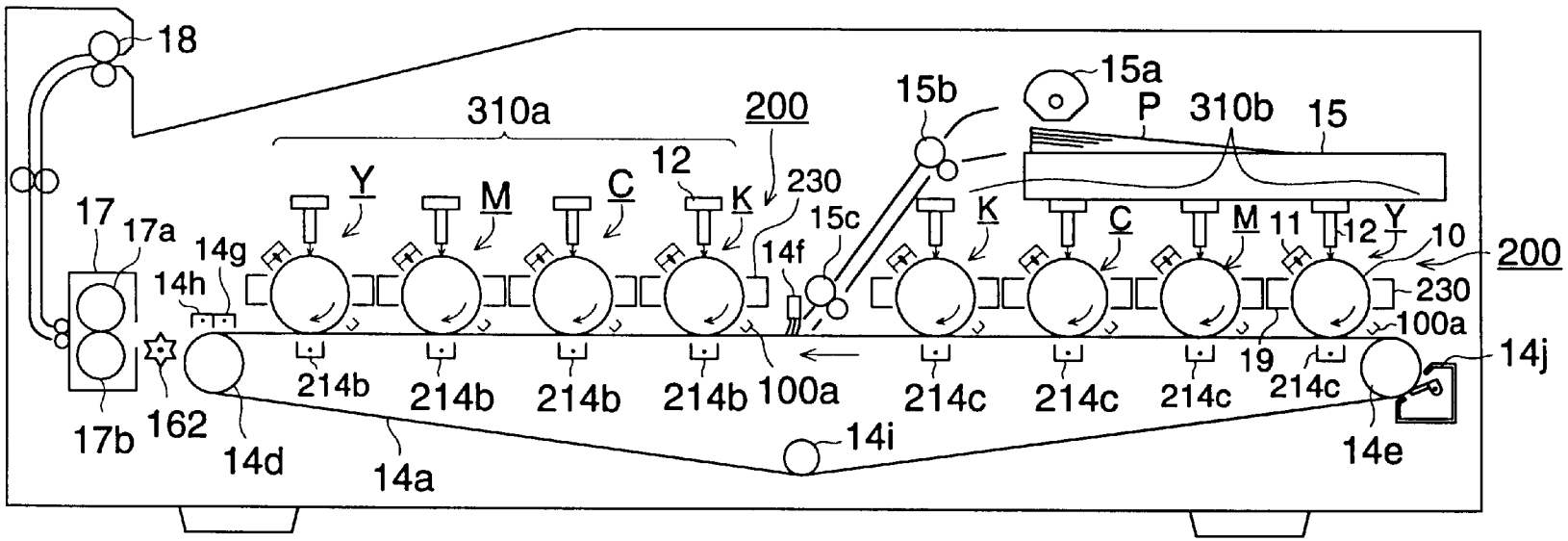
FIG. 12 is a structural sectional view of a color printer as the color image forming apparatus showing the second example of the two-sided image forming apparatus of the present invention.

The second example of the two-sided image forming apparatus of the present invention will be shown in FIG. 12. FIG. 12 is a structural sectional view of a color printer as a color image forming apparatus which shows the second example of the two-sided image forming apparatus of the present invention. Members having the same function and structure as those in the first example are denoted by the same numeral codes.

In the second example, instead of the first and second color image forming units 300*a* and 300*b*, as shown in FIG. 12, the second color process unit group 310*b* for color toner image formation of the rear side image, and the first color process unit group 310*a* for color toner image formation of the front side image, are used, and the front and rear superimposed color toner images are respectively formed.

The second color process unit group 310*b* for the rear side image formation which is opposed to the intermediate transfer belt 14*a* serving as the intermediate transfer body stretched plane-like by the driving roller 14*d*, driven roller 14*e* and tension roller 14*i*, and is located at the upstream side in the moving direction of the intermediate transfer belt 14*a*, is structured by color process units 200 for each color of yellow(Y), magenta (M), cyan (C) and black (K), each having the photoreceptor drum 10 serving as the image carrier, the scorotron charger 11 serving as the charging means, the exposure unit 12 serving as the imagewise exposure means, the developing unit 230 serving as the developing means, and the cleaning unit 19 serving as the cleaning means of the image carrier, on the outer periphery of the photoreceptor drum 10, and these color process units 200 are respectively arranged opposed to the intermediate transfer belt 14*a*. In each of color process units 200, the sensor unit 100*a* having the potential sensor and the reflection density sensor for each color, corresponding to the color of the color process unit 200, is provided. The color process unit 200 for each color of the second color process unit group 310*b* is arranged in the order of Y, X, C and K from the upstream side in the moving direction of the intermediate transfer belt 14*a*.

The first color process unit group 310*a* for the front side image formation which is opposed to the intermediate transfer belt 14*a* serving as the intermediate transfer body stretched plane-like, and is located at the downstream side in the moving direction of the intermediate transfer belt 14*a*, is structured by color process units 200 for each color of black (K), cyan (C), magenta (M), and yellow(Y), each having the photoreceptor drum 10 serving as the image carrier, the scorotron charger 11 serving as the charging means, the exposure unit 12 serving as the imagewise exposure means, the developing unit 230 serving as the developing means, and the cleaning unit 19 serving as the cleaning means of the image carrier, on the outer periphery of the photoreceptor drum 10, and these color process units 200 are respectively arranged opposed to the intermediate transfer belt 14*a*. In each of color process units 200, the sensor unit 100*a* having the potential sensor and the reflection density sensor for each color, corresponding to the color of the color process unit 200, is provided. The color process unit 200 for each color of the first color process unit group 310*a* is arranged in the order of K, C, M and Y from the upstream side in the moving direction of the intermediate transfer belt 14*a*, in which the order of arrangement of each color process unit 200 of the first color process unit group 310*a* is entirely reversed to that of each color process unit 200 of the second color process unit group 310*b* (the order of Y, M, C and K).

The toner images for each color of the rear side image formed by the color process unit 200 of each color of Y, M, C and K provided in the second color process unit group 310*b* are successively transferred onto the intermediate transfer belt 14*a* by the transfer unit 214*c* in the order of Y, M, C and K, and the superimposed color toner image of the rear side image is formed on the intermediate transfer belt 14*a* by the second color process unit group 310*b*.

The recording sheet P, which is a transfer material, is sent from a sheet feed cassette 15, which is a recording sheet accommodating means, by a sheet sending roller 15*a*, fed by a sheet feeding roller 15*b*, and is conveyed to a timing roller 15*c* located between the first color process unit group 310*a* and the second color process unit group 300*b*.

The recording sheet P is sent by the drive of the timing roller 15*c* so that it is in timed relationship with the rear side image formed on the intermediate transfer belt 14*a*, by the second color process unit group 310*b*; paper-charged by the paper charger 14*f* to the same polarity as the toner; and attracted to the intermediate transfer belt 14*a* and is sent to the first color process unit group 310*a*.

The toner image of the front side image is formed by the color process unit 200 provided in the first color process unit group 310*a* in timed relationship with the color toner image of the rear side image of the sent recording sheet P. The toner images formed of black toner and color toners are formed in the sequence of K, C, M and Y toners, which is entirely reversed to the sequence of Y, M, C and K toners in the case of rear side color image formation. The toner images are successively transferred onto the recording sheet P by the front side transfer unit 214*b*, and the superimposed color toner image of the front side image is formed on the recording sheet P by the first color process unit group 310*a*. It is necessary to change image data so that the front side image by each color process unit 200 of the first color process unit group 310*a* formed in this case, is formed to be a mirror image of the rear side image formed on the photoreceptor drum 10 of each color process unit 200 of the second color process unit group 310*b*, on the photoreceptor drum 10.

By a front side transfer unit 14*b* which applies the voltage having reverse polarity to toner (in the present example, positive polarity), front side images on the peripheral surface of the photoreceptor drum 10 of the color process unit 200 provided in the first color process unit group 310*a* are successively transferred onto the upper surface side of the recording sheet P. In this case, the rear side images on the peripheral surface of the intermediate transfer belt 14*a* are not transferred onto the recording sheet P, but exist on the intermediate transfer belt 14*a*. Next, the rear side images on the surface of the intermediate transfer belt 14*a* are collectively transferred onto the lower surface side of the recording sheet P by a rear side transfer unit 14*g* which applies the voltage having reverse polarity to toner (in the present example, positive polarity).

The recording sheet P on both sides of which color toner images are formed, is discharged by a paper separation AC discharger 14*h* for recording sheet separation, separated from the intermediate transfer belt 14*a*, and through a spurred wheel 162 to prevent the frictional damage of the toner image of the rear side image on the recording sheet P, it is conveyed to the fixing unit 17 serving as a fixing means, which is structured by two rollers each having a heater therein. The toner adhered onto the front and rear sides of the recording sheet P is fixed by the application of heat and pressure between a fixing roller 17*a* and a pressure-contact roller 17*b*, and then, the recording sheet P on both sides of which images are recorded is reversed upside down and conveyed to the delivery sheet roller 18, and is delivered onto a tray outside the apparatus.

In the case of toner image formation of the rear side image in the color process unit 200 in the order of Y, M, C, K, provided in the above cited second color process unit group 310*b*, or in the case of toner image formation of the front side image in the color process unit 200 in the order of K, C, M, Y, provided in the above cited first color process unit group 310*a*, in the same manner as described above first example, the control of respective image data processing condition in the rear side image or the front side image described in FIG. 4, and the control of the process condition of the image formation such as charging means, imagewise exposure means, developing means, corresponding to the rear side image and the front side image in each color process unit 200 of the second color process unit group 310*b* for the rear side image, and each color process unit 200 of the first color process unit group 310*a* for the front side image, are conducted for each color process unit 200, using the sensor unit 100*a* having the potential sensor and reflection density sensor, provided in each color process unit 200.

That is, the correction of the charging potential and light amount of the imagewise exposure light by the potential sensor for each of Y, M, C, K and for each of front and rear sides in the same manner as in FIGS. 5 and 6, the γ-correction for each of Y, M, C, K and for each of front and rear sides in the same manner as in FIGS. 7 through 9, or the masking correction for each of the front and rear sides in the same manner as in FIG. 11 is carried out, and the superimposed color toner image is formed in the same order of K, C, M, Y on both the front and rear sides, viewing from the recording sheet P surface, in the same manner as shown FIG. 10. Alternatively, as another correction method, the following method is adopted: the correction of the process condition (charging potential and exposure amount) or image data of the rear side image is determined by presuming from experiment data previously obtained for the correction condition of the process condition (charging potential and exposure amount) of the front side image. For example, because two-time correction is carried out for the front side image formation, in order to adhere the same amount of toner onto the recording sheet P, it is necessary that the toner image, previously having about 10% larger amount of toner, is formed on the photoreceptor drum 10. In the case of the rear side image formation, the adjustment condition is previously determined as follows: the maximum charging potential VS is increased by 10%; the maximum exposure amount is increased by 10%; because the half tone dot is deformed and γ is hardened by the two-time transfer, a previously laid γ-correction curve is used; or because the resolving power of the character is decreased by toner scattering by the two-time transfer, a filter correction value in which the correction by an MTF filter is previously enhanced, is used. Thereby, the adjustment is carried out so that the amount of toner is the same for the front side image and the rear side image.

Further, as described in FIG. 10, in both of superimposed color toner images on the front and rear sides, black (K) is the lowermost, and C, M and Y are sequentially superimposed on the recording sheet (on both the front and rear sides, the superimposed color toner image is formed in the order of K, C, M, Y from the surface of the recording sheet P). In this case, because the transfer rate changes depending on each toner, the change of parameter setting for masking for color correction as shown by SA9, SB9 in FIG. 4 is required in addition to the correction of each density data, in the case of color image.

Further, in the same manner as described in FIG. 11, in the UCR correction, generally, the UCR value is 30 to 100%, and is reproduced by four colors of three color toners and black toner, rather than reproduction by only three colors of Y, M, C. The UCR value is also appropriately changed in addition to the change of masking parameter in both of the front side image and the rear side image.

The above-cited color correction in the masking section is carried out including color processing such as masking, black printing, and UCR. As the masking, linear masking, which is generally carried out, or non-linear masking or masking using a look-up table when the higher color correction is carried out, is used.

As described above, in also the second example, in the case of monochromatic or color image formation by the color image forming apparatus, image formation is carried out by using the process condition and the image data processing condition set in the above description, and thereby, two-sided image formation with finely adjusted image density and color tone is carried out.

Further, as a variation of the above description, by changing only one condition, the rear side image formation may be carried out. Specifically, in the case of the monochromatic image formation, the color correction is not necessary, and if the maximum density of black is the saturated image density, a sufficient level image can be reproduced even by only gradation correction.

According to the present invention, on both sides of the recording sheet P, two-sided image formation with finely adjusted image density and color tone is carried out.

What is claimed is:

1. A two-sided color image forming apparatus comprising:

(a) a first color image forming unit having an image carrier, a plurality of imagewise exposure means and a plurality of color developing units which contain therein respective colored toners different from each other, provided on a periphery of the image carrier;

(b) a second color image forming unit having an image carrier, a plurality of imagewise exposure means and a plurality of color developing units which contain therein respective colored toners different from each other, provided on a periphery of the image carrier;

(c) a belt-shaped intermediate transfer body passing through the first and second color image forming units for receiving thereon a toner image formed by the second color image forming unit, wherein the first color image forming unit is disposed downstream with respect to a moving direction of the belt-shaped intermediate transfer body while the second color image forming unit is disposed upstream with respect to the moving direction of the belt-shaped intermediate transfer body, and wherein an arrangement order of the plurality of imagewise exposure means and the plurality of color developing units in the first color image forming unit with respect to respective colors in a rotation direction of the image carrier is opposite to that of the plurality of imagewise exposure means and the plurality of color developing units in the second color image forming unit;

(d) a sheet pass for conveying a recording sheet onto the belt-shaped intermediate transfer body passing between the first and second image forming units;

(e) a first transfer device for transferring the toner image formed by the second color image forming unit onto the belt-shaped intermediate transfer body; and (f) a second transfer device for directly transferring a toner image formed by the first color image forming unit onto one side of the recording sheet conveyed by the belt-shaped intermediate transfer body; and (g) a third transfer device for transferring the toner image formed by the second color forming unit and transferred on the belt-shaped intermediate transfer body, onto the other side of the recording sheet.

2. The two-sided color image forming apparatus of claim 1, wherein an image forming condition of the toner images to be transferred onto the one side and the other side of the recording sheet is an image data processing condition such as γ-correction or color-correction.

3. The two-sided color image forming apparatus of claim 1, wherein said respective plurality of imagewise exposure means of the first and second color image forming units are disposed inside said respective image carriers.

4. The two-sided color image forming apparatus of claim 1, wherein an image forming condition or a process condition of a toner image to be transferred onto one side of the recording sheet is different from that of a toner image to be transferred onto the other side of the recording sheet.

5. The two-sided color image forming apparatus of claim 1, wherein an image forming condition of toner images to be transferred onto one side and the other side of the recording sheet is a process condition such as charging, exposing, or developing.

6. A two-sided color image forming apparatus comprising:

(a) a first color process unit group comprising a plurality of color process units each including an image carrier, an imagewise exposure means and a developing device containing therein colored toner different from each other for developing a latent image formed on the image carrier;

(b) a second color process unit group comprising a plurality of color process units each including an image carrier, an imagewise exposure means and a developing device containing therein colored toner different from each other for developing a latent image formed on the image carrier;

(c) a belt-shaped intermediate transfer body for receiving toner images formed by the second color process unit group, wherein the first color process unit group is disposed in a periphery and downstream of a moving direction of the belt-shaped intermediate transfer body while the second color process unit group is disposed in the periphery and upstream of the moving direction of the belt-shaped intermediate transfer body, and wherein an arrangement order of the plurality of color process units in the first color process unit group with respect to respective colors in the moving direction of the belt-shaped intermediate transfer body is opposite to that of the plurality of color process units in the second color process unit group;

(d) a sheet pass for conveying a recording sheet onto the belt-shaped intermediate transfer body passing between the first and second process unit groups;

(e) a first transfer device provided for each of said plurality of color process units in the second color process unit group, for transferring a toner image formed by the second color process unit group onto the belt-shaped intermediate transfer body;

(f) a second transfer device provided for directly transferring a toner image formed by the first color process unit group onto one side of the recording sheet conveyed by the belt-shaped intermediate transfer body; and (g) a third transfer device for transferring the toner image formed by the second color process unit group and transferred on the belt-shaped intermediate transfer body, onto the other side of the recording sheet.

7. The two-sided color image forming apparatus of claim 6, wherein an image forming condition of the toner images to be transferred onto the one side and the other side of the recording sheet is an image data processing condition such as γ-correction or color-correction.

8. The two-sided color image forming apparatus of claim 6, wherein an image forming condition or a process condition of a toner image to be transferred onto one side of the recording sheet is different from that of a toner image to be transferred onto the other side of the recording sheet.

9. The two-sided color image forming apparatus of claim 6, wherein an image forming condition of toner images to be transferred onto one side and the other side of the recording sheet is a process condition such as charging, exposing, or developing.

* * * * *